US008123593B2

(12) United States Patent
Hoon

(10) Patent No.: US 8,123,593 B2
(45) Date of Patent: Feb. 28, 2012

(54) CONFIGURING OF LAPPING AND POLISHING MACHINES

(75) Inventor: Douglas Martin Hoon, Guilford, CT (US)

(73) Assignee: Zygo Corporation, Middlefield, CT (US)

( * ) Notice: Subject to any disclaimer, the term of this patent is extended or adjusted under 35 U.S.C. 154(b) by 540 days.

(21) Appl. No.: 12/437,238

(22) Filed: May 7, 2009

(65) Prior Publication Data

US 2009/0280721 A1 Nov. 12, 2009

Related U.S. Application Data

(60) Provisional application No. 61/126,724, filed on May 7, 2008.

(51) Int. Cl.
*B24B 49/00* (2012.01)

(52) U.S. Cl. ..... 451/8; 451/5; 451/6; 451/21; 451/57; 33/546

(58) Field of Classification Search ..... 451/5, 6, 451/8, 57, 56, 21, 259, 283, 443; 73/104, 73/105; 33/546, 551, 553, 354, 501.06
See application file for complete search history.

(56) References Cited

U.S. PATENT DOCUMENTS

| | | | | |
|---|---|---|---|---|
| 2,772,521 | A * | 12/1956 | Voytech | 451/56 |
| 2,883,803 | A * | 4/1959 | Stead | 451/286 |
| 3,161,996 | A * | 12/1964 | Roshong | 451/1 |
| 3,638,366 | A * | 2/1972 | Gamache | 451/57 |
| 4,914,828 | A * | 4/1990 | Fiedor et al. | 33/554 |
| 5,679,055 | A | 10/1997 | Greene et al. | |
| 5,718,618 | A * | 2/1998 | Guckel et al. | 451/41 |
| 5,868,605 | A * | 2/1999 | Cesna | 451/41 |
| 5,974,679 | A * | 11/1999 | Birang et al. | 33/553 |
| 6,048,254 | A * | 4/2000 | Duescher | 451/28 |
| 6,050,879 | A * | 4/2000 | Dubrovskiy et al. | 451/36 |
| 6,102,777 | A * | 8/2000 | Duescher et al. | 451/36 |
| 6,149,506 | A * | 11/2000 | Duescher | 451/59 |
| 6,231,425 | B1 * | 5/2001 | Inaba et al. | 451/5 |
| 6,575,622 | B2 * | 6/2003 | Norrbakhsh et al. | 374/141 |
| 6,769,968 | B2 * | 8/2004 | So | 451/56 |
| 6,881,124 | B2 * | 4/2005 | Takahashi et al. | 451/5 |
| 6,932,684 | B1 * | 8/2005 | Hunt | 451/264 |
| 7,070,478 | B2 * | 7/2006 | Elledge et al. | 451/6 |
| 7,107,694 | B2 * | 9/2006 | Yang et al. | 33/18.1 |
| 7,147,540 | B2 * | 12/2006 | Tanaka et al. | 451/5 |
| 2009/0122008 | A1 * | 5/2009 | Melkis et al. | 345/157 |
| 2009/0280721 | A1 * | 11/2009 | Hoon | 451/5 |

FOREIGN PATENT DOCUMENTS

| | | |
|---|---|---|
| EP | 0868976 | 7/1997 |
| KR | 1998-0019379 | 6/1998 |

OTHER PUBLICATIONS

International Search Report and Written Opinion dated Dec. 22, 2009 for corresponding PCT application PCT/US2009/043153.

* cited by examiner

*Primary Examiner* — George Nguyen
(74) *Attorney, Agent, or Firm* — Fish & Richardson P.C.

(57) ABSTRACT

A lapping or polishing machine includes a material having a first finishing surface to process a surface of a work item, a measuring tool to measure a contour of the first finishing surface, and a conditioning tool having a second finishing surface to process the first finishing surface to reduce a difference between the measured contour and a desired contour of the first finishing surface.

43 Claims, 6 Drawing Sheets

CONFIGURING OF LAPPING AND POLISHING MACHINES

RELATED APPLICATION

This application claims priority to U.S. Provisional Application No. 61/126,724, filed May 7, 2008, titled "NOVEL LAPPING AND POLISHING MACHINE CONFIGURATION AND METHOD." The entire content of the above application is incorporated by reference.

FIELD OF THE INVENTION

This document generally relates to configuring of lapping and polishing machines.

BACKGROUND

A lapping or polishing machine can be used to finish a broad range of materials, e.g., glasses, ceramics, plastics, and metals. The item being finished (lapped or polished) rides on top of the finishing surface (lap), in which the lap is substantially larger than the item being lapped or polished. The lapping or polishing process gradually removes parts of the item to cause the item to have a desired surface profile. The removal process takes place as the result of mechanical interaction or a combination of chemical and mechanical interaction between the item being finished, an abrasive, and the lap surface. This process is generally rate determined by an equation involving both the relative speed between the lap and the finished item and the pressure at the interface. Lapping machine laps can be, e.g., cast iron. Polishing machine laps can include, e.g., any of a family of compounds known as "pitch" or any of a family of synthetic materials such as urethanes.

SUMMARY

In one aspect, in general, a method of processing a work item includes configuring a first finishing surface of a processing machine using a conditioning tool having a second finishing surface, measuring a contour of the first finishing surface, using the second finishing surface to process the first finishing surface to reduce a difference between the measured contour and a desired contour for the first finishing surface, and using the first finishing surface to process a work item to cause the work item to have a surface contour that is equal to or approximates a specified surface contour.

Implementations of the method may include one or more of the following features. Configuring a first finishing surface of a processing machine includes configuring a first finishing surface of at least one of a lapping machine or a polishing machine.

Using a conditioning tool having a second finishing surface includes using a conditioning tool having a second finishing surface that has a diameter smaller than a diameter of a surface of the work item. The method includes generating ripples on the first finishing surface as the second finishing surface processes various portions of the first finishing surface, the ripples having a spatial period that is smaller than the diameter of the work item. The method includes canceling effects of the ripples on the first finishing surface when processing the work item using the first finishing surface.

Measuring the contour of the first finishing surface includes moving a measurement object across the first finishing surface and measuring positions of the measurement object while the measurement object follows the contour of the first finishing surface. The first finishing surface includes a surface of a material having grooves that cause discontinuities in the first finishing surface, and the measurement object has a diameter that is larger than a maximum width of the grooves. Measuring positions of the measurement object includes at least one of (a) using a linear variable displacement transducer to measure the positions of the measurement object, (b) using a capacitive gauge to measure the positions of the measurement object, (c) using an inductive gauge to measure the positions of the measurement object, or (d) using a displacement measuring interferometer to measure positions of a mirror or retro-reflector attached to the measurement object.

The method includes using the first finishing surface to process the work item in parallel to measuring the contour of the first finishing surface and using the second finishing surface to process the first finishing surface.

Using the first finishing surface to process a work item includes using the first finishing surface to process a surface includes at least one of glass, ceramic, plastic, or metal.

In some examples, configuring a first finishing surface includes configuring a first finishing surface of a solid substrate. In some examples, configuring a first finishing surface includes configuring a first finishing surface of a polishing pitch.

In another aspect, in general, a method includes moving a measurement object across a finishing surface of a material of a processing machine for processing surface contours of work items, the material having grooves that cause discontinuities in the finishing surface, the measurement object having a dimension that is larger than a maximum width of the grooves; measuring positions of the measurement object; and determining, using a computer, a contour of the finishing surface based on the measurements of the positions of the measurement object.

Implementations of the method may include one or more of the following features. The method includes comparing the determined contour with a desired contour for the first finishing surface, and using a conditioning tool to process the first finishing surface to reduce a difference between the determined contour and the desired contour for the first finishing surface. The method includes using the first finishing surface to process a work item to cause the work item to have a specified surface contour.

Measuring positions of the measurement object includes at least one of (a) using a linear variable displacement transducer to measure the positions of the measurement object, (b) using a capacitive gauge to measure the positions of the measurement object, (c) using an inductive gauge to measure the positions of the measurement object, or (d) using a displacement measuring interferometer to measure positions of a mirror or a retro-reflector attached to the measurement object.

The material includes polishing pitch.

In another aspect, in general, an apparatus includes a material having a first finishing surface to process a surface of a work item; a measuring tool to measure a contour of the first finishing surface; and a conditioning tool having a second finishing surface to process the first finishing surface to reduce a difference between the measured contour and a desired contour of the first finishing surface.

Implementations of the apparatus may include one or more of the following features. The material includes grooves that cause discontinuities in the first finishing surface. The material includes polishing pitch. The measuring tool includes a measurement object that moves across the first finishing surface, the measurement object having a size that is larger than a maximum width of the grooves. The measuring tool includes a stage to support a sensor that senses positions of the measurement object, the stage constraining movements of the measurement object. The stage constrains the movements of the measurement object such that the measurement object has a single degree of freedom. The measurement object has a smooth surface that contacts the first finishing surface, the smooth surface having a dimension that is larger than the maximum width of the grooves. The measuring tool includes at least one of a linear variable displacement transducer to measure positions of the measurement object, a capacitive gauge to measure positions of the measurement object, an inductive gauge to measure positions of the measurement object, or a displacement measuring interferometer to measure positions of a mirror or a retro-reflector attached to the measurement object.

The second finishing surface has a size that is smaller than a size of a surface of the work item.

The second finishing surface has a diameter that is less than one-half of a diameter of a surface of the work item.

The substrate includes at least one of cast iron or granite.

The substrate has a diameter of at least 3 feet, and the measuring tool has a resolution of 10 microns or smaller.

The apparatus includes a controller to control processing of the work item by the first polishing surface in parallel to using the measuring tool to measure the contour of the first finishing surface and using the conditioning tool to process the first finishing surface.

The apparatus includes a positioning device to position the measuring tool. The positioning device includes a precision slide mechanism.

The apparatus includes a positioning device to position the conditioning tool. The positioning device includes a precision slide mechanism.

The apparatus includes a pressure control device to control a pressure applied by the second finishing surface to the first finishing surface.

In another aspect, in general, an apparatus includes a material having a finishing surface to process a work item, the material includes grooves that cause discontinuities in the finishing surface; a measuring device to measure a contour of the finishing surface, the measuring device includes a measurement object that moves across the finishing surface and having a dimension larger than a maximum width of the grooves; and a data processor to determine a contour of the finishing surface based on the measurements of positions of the measurement object.

Implementations of the apparatus may include one or more of the following features. In some examples, the material includes polishing pitch. In some examples, the material includes a solid substrate.

The measuring device includes a measurement object that moves across the first finishing surface, the measurement object having a diameter that is larger than a maximum width of the grooves. The measuring device includes a stage to support a sensor that senses positions of the measurement object, the stage constraining movements of the measurement object. The stage constrains the movements of the measurement object such that the measurement object has a single degree of freedom.

The measuring device includes at least one of a linear variable displacement transducer to measure the positions of the measurement object, a capacitive gauge to measure positions of the measurement object, an inductive gauge to measure positions of the measurement object, or a displacement measuring interferometer to measure positions of a mirror or retro-reflector attached to the measurement object.

The second finishing surface has a diameter that is smaller than a diameter of a surface of the work item.

These and other aspects and features, and combinations of them, may be expressed as methods, apparatus, systems, means for performing functions, program products, and in other ways.

Advantages of the aspects, systems, and methods may include one or more of the following. Work items, such as optical elements, can be processed with high accuracy. The lapping machine or polishing machine can be easily operated through a control computer. Other features, objects, and advantages of the invention will be apparent from the following detailed description.

DETAILED DESCRIPTION

Overview

Figure 1:
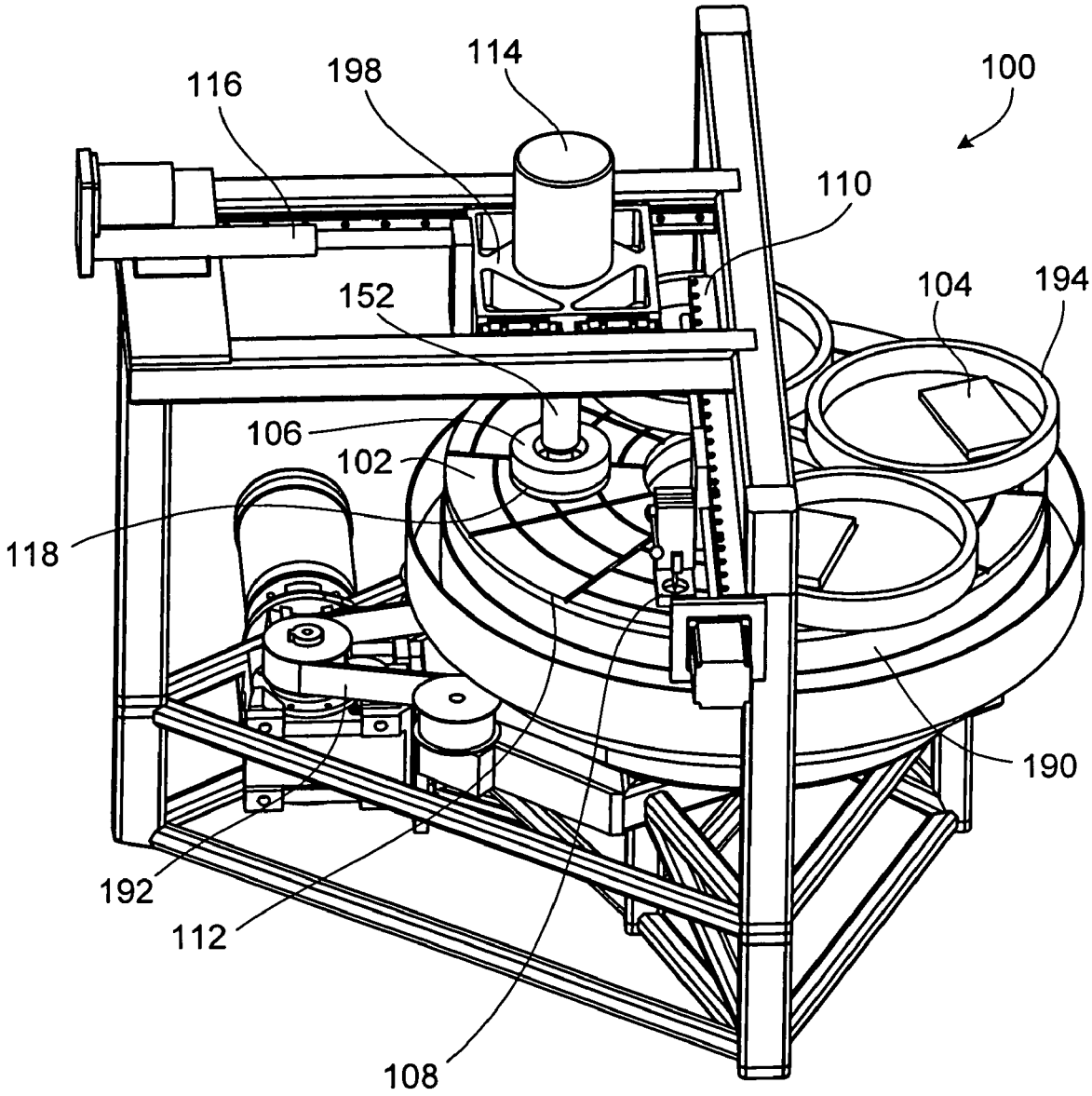
FIGS. 1 and 2 are perspective views of an example polishing machine.
Figure 2:
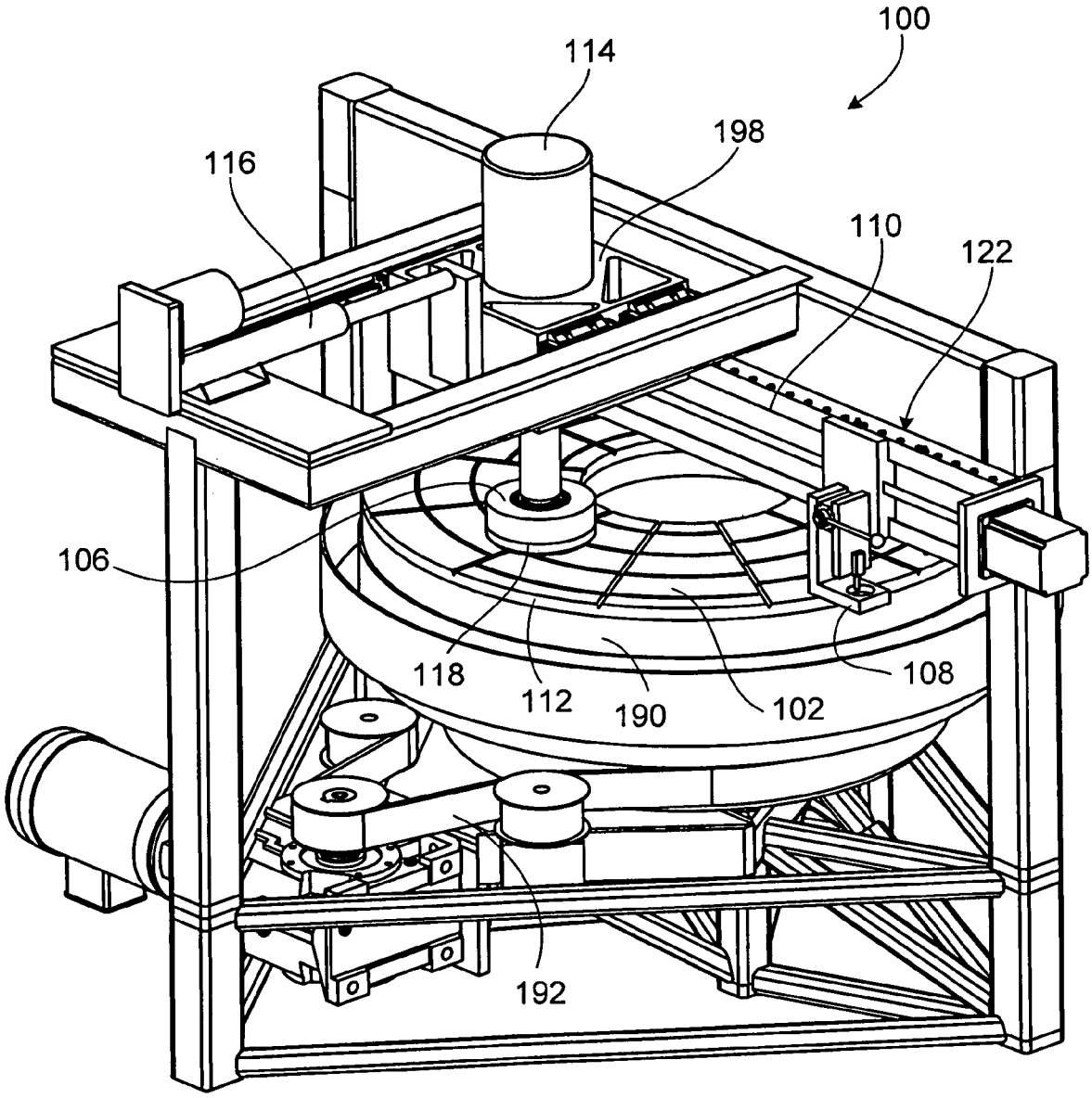

FIGS. 1 and 2 are perspective views of a polishing machine 100 as viewed from different viewing angles.

Referring to FIG. 1, the polishing machine 100 includes a layer of polishing pitch 112 having a finishing lap surface 102 that processes work items 104 (e.g., optical elements) to cause the work items 104 to have desired surface contours (e.g., plano, convex, or concave contours). A small conditioning tool 106 operated under computer control configures and corrects the shape of the finishing lap surface 102 based on real-time measurements of the contour of the lap surface 102. The conditioning tool 106 corrects the shape of the finishing surface 102 as soon as the measurements are made by a measuring device 108. An error map is generated by comparing the measurements of the finishing surface contour with a desired contour, and the conditioning tool 106 processes the lap surface 102 to reduce the error.

In this document, the item being finished is referred to as a "work item," which can be, e.g., an optical element or any other object that requires fine surface shape and smoothness.

The small-tool lap figuring process can be used for flat (plano) surfaces as well as for concave or convex finishing surfaces, or other surface geometries. Based on the measured error in the figure of the lap surface 102 (deviation from a desired shape), a computer algorithm calculates the pressure or dwell profile for control of the motion of the conditioning tool 106 to remove the observed errors.

In some implementations, operating the polishing machine 100 to process the work items 104 involve the following steps: (a) measurement of the lap contour and creation of a surface map; (b) comparison of the existing lap surface to a desired surface; (c) calculation of the required motion and pressure profile for the conditioning tool 106 as it moves over the lap surface 102; (d) execution of the calculated conditioning tool program; and (e) adjustments by an operator to adjust the desired or target lap shape against which the actual shape is compared to achieve the desired final part requirements. These steps are repeated continuously to converge on a surface figure for the work item that meets design specifications.

The polishing machine 100 has several advantages. For example, the measuring tool 108 can measure the lap surface profile with a high resolution to detect small figure errors. The measuring tool 108 can have micron or sub-micron resolution. The conditioning tool 106 can be small, and the motion path and pressure profiles of the conditioning tool 106 can be controlled by computer programming, resulting in a more accurate and predictable lap surface contour. The process for conditioning the lap surface 102 provides for a deterministic means of shaping the lap surface 102 with less operator intervention, as compared to a conventional method of examining a sample work item that is processed by the lap surface 102 to determine how the lap surface 102 should be corrected.

The polishing machine 100 may also have the following advantage. Undesirable surface characteristics imparted by small-tool finishing can be avoided by using the small conditioning tool 106 to process the lap surface 102, and using the lap surface 102 to process the work item 104, instead of using a small tool to process the work item 104 directly. In conventional small-tool finishing, where a small conditioning tool is used to process the surface of the work item directly, "ripples" may be imposed on the surface of the work item as the small conditioning tool processes one portion after another on the surface of the work item. When using the polishing machine 102, although the small conditioning tool 106 may cause ripples to occur on the lap surface 102, the small conditioning tool 106 can be selected so that the ripples have a spatial period smaller than the dimension of the work item 104. The ripples are not transferred to the work item 104 because of the motion and shape averaging that occurs as the lap surface 102 sweeps under the work item 104.

In the example of FIG. 1, the polishing pitch 112 is disposed above a heavy substrate 190, which is rotated by a belt drive mechanism 192. Other drive configurations, such as direct drive, are also possible. Each work item 104 is placed in a carrier ring 194, which has an opening to allow a lower surface of the work item 104 to contact the lap surface 102. In some examples, the carrier ring 194 rotates as the lap surface 102 rotates, allowing the lower surface of the work item 104 to be uniformly processed by the lap surface 102. The polishing pitch 112 can be made of a combination of materials, e.g., wax, pine tar pitch, and bituminous elements. The polishing pitch 112 may be viscous and change shape as pressure is applied to it.

Process for Conditioning the Lap Surface

One of the steps in conditioning the lap surface 102 is to measure the actual lap surface 102. In some implementations, data that are produced from measurement of the lap surface 102 can be used to generate a motion and pressure profile for the conditioning tool 106. The measurement can be a densely populated surface map of the entire lap surface 102, with data points spaced as a function of the overall size of the lap surface 102 and the size of the conditioning tool 106. For example, the density may vary from several points per square inch to one point for every 2 to 4 square inches. The goal is to have sufficient data to capture the spatial frequencies of concern to the user without over-burdening the computer calculation of overall lap shape.

For ease of calculation, the location of each measurement can be planned and executed with computer control of the measuring device 108. In some examples, algorithms used to analyze regular pixel spaced data from charge coupled device (CCD) arrays can be adapted to measure the finishing surface contour. The measurement accuracy, precision, and resolution of the measuring device 108 can depend on the requirements of the work items 104. For example, the measuring device 108 can use linear variable displacement transducers (LVDTs), inductive or capacitance gauges, or displacement measuring interferometers (DMIs), each having micron or sub-micron resolution. As described below, lap measurements can be referenced either to a linear slide 110 used to translate the measuring device 108 over the lap surface 102, or to an external reference such as a precision bar mirror. The data that are collected by the measuring device 108 can be analyzed using a variety of techniques, such as MetroPro software, available from Zygo Corporation, Middlefield, Conn.

Once a map of the actual lap shape is generated, a comparison is made to a desired surface profile, which can be mathematically defined. In some examples, the measurement data for the lap surface 102 is reduced (e.g., averaged over small regions) to reduce the computing time. In the case of a plano target shape, any deviation of the measured lap surface profile from a best-fit plane defines the error. For example, in the case of comparison to a desired spherical surface, errors can be defined as deviations of the measured lap surface profile from a mathematically defined spherical surface superimposed on the lap surface 102. For example, the MetroPro software can be used to generate the error map.

After an error map is generated, the motion and pressure profiles for the conditioning tool 106 is calculated. Calculation of the motion and pressure profiles of the conditioning tool 106 follows from an analysis of the error map and can include characterization of a work function, i.e., the surface deformation created by the conditioning tool 106 when applied at a given pressure and with known motion characteristics, and convolution of this work function over the error map.

In some implementations, the polishing pitch 112, the substrate 190, and associated support mechanism of the polishing machine 100 may have a mass of many tons and do not lend itself well to frequent changes in velocity. Furthermore, changes in the rotation rate of the lap may translate into undesirable errors in the shape of the work item surface. The small conditioning tool 106 achieves variation in local lap surface change through tool rotary speed about its own axis and/or pressure. For example, pressure variation can be applied to the pitch polishing lap where shape change occurs as the result of viscous flow of the pitch.

The work function of the conditioning tool 106 is generated by measuring the "before" and "after" of a surface of the polishing pitch 112 that is modified using a known pressure profile of the conditioning tool 106. For example, a pitch lap is measured and mapped. The conditioning tool 106 is placed at a known radial position and held in this position at a fixed pressure through, e.g., 5 revolutions of the polishing lap. The lap surface 102 is re-measured and re-mapped, and the effect of this particular pressure setting is characterized. Several additional trials may follow with different pressure settings so that a linear (or non-linear) relationship can be established between pressure and lap deformation. This functionally derived relationship is stored in computer memory (or a hard drive or other storage medium) and used in subsequent profile calculations as the required work function. This characterization is repeated and modified as conditions change when, for example, the pitch ages, a new type of pitch is used, the size of the conditioning tool is changed, the temperature of the environment changes.

The required motion and pressure profiles for the conditioning tool 106 are translated to a language that can be used by a machine control system that controls the position and pressure of the small conditioning tool 106. For example, a precision slide mechanism 116 that moves a supporting stage 198 that supports a hydraulic device 114 and the conditioning tool 106 along a radial direction. The hydraulic device 114 determines the pressure the conditioning tool 106 applies to the lap surface 102.

The conditioning tool 106 is controlled by a control computer 160 (FIG. 5) with closed loop position and velocity or pressure control. In some examples, the computer 160 may execute software that controls the conditioning tool 106 according to instructions in a G-Code program. G-Code is a set of commands that define certain types of motions and can be applied across a wide range of commercial products. For example, there are commands that can be used to control peripheral devices, such as turning on or off motors, turning on slurry or cooling systems, varying flow or pressure settings. G-Code can be generated by software or post-processors that take path and speed data from one program (e.g., the error mapping software) and automatically generate the line-by-line instructions needed to cause the conditioning tool 106 to move to selected positions and impart selected pressures to the lap surface.

After the G-Code programming is completed, the execution of the program can be performed by the computer 160 without operator intervention. The polishing machine 100 can be set up such that a new metrology sequence is initiated as soon as the program execution has been completed, and a new round of lap surface mapping, error map generation, and correction steps are performed in a continuous loop of automated machine measurement and correction.

A human operator may intervene from time to time, such as when parameters (e.g., material type, room environmental conditions, aging of the lap surface) change over time, causing the overall outcome of the polishing process to vary. The operator may perform minor adjustments to compensate for the variations. For example, the operator may make minor adjustments to the shape of the lap surface 102 from time to time. For example, the changes can be small changes in the concave or convex radius of the curvature of the lap.

In some implementations, the polishing machine 100 allows an operator to enter the exact radius of curvature through the control computer 160. This makes the polishing machine 100 easier to operate, allowing lower skilled technicians to process work items with high precision. For example, the change process can be as simple as entering one number—the radius of curvature desired—through a graphical user interface (GUI) 178 provided by control computer 160. Other types of control change can be used, such as using graphical "sliders" and other GUI tools offered, for example, in LabVIEW, a program available from National Instruments, Austin, Tex.

Polishing Machine Features

The polishing machine 100 includes a lap metrology system for measuring the contour of the lap surface 102. The lap metrology system includes the measuring device 108 and a positioning subsystem for controlling the position of the measuring device 108. The measuring device 108 can be configured to resolve dimensions on the order of 1 micron or less and can interface with a computer data acquisition system.

Figure 3:
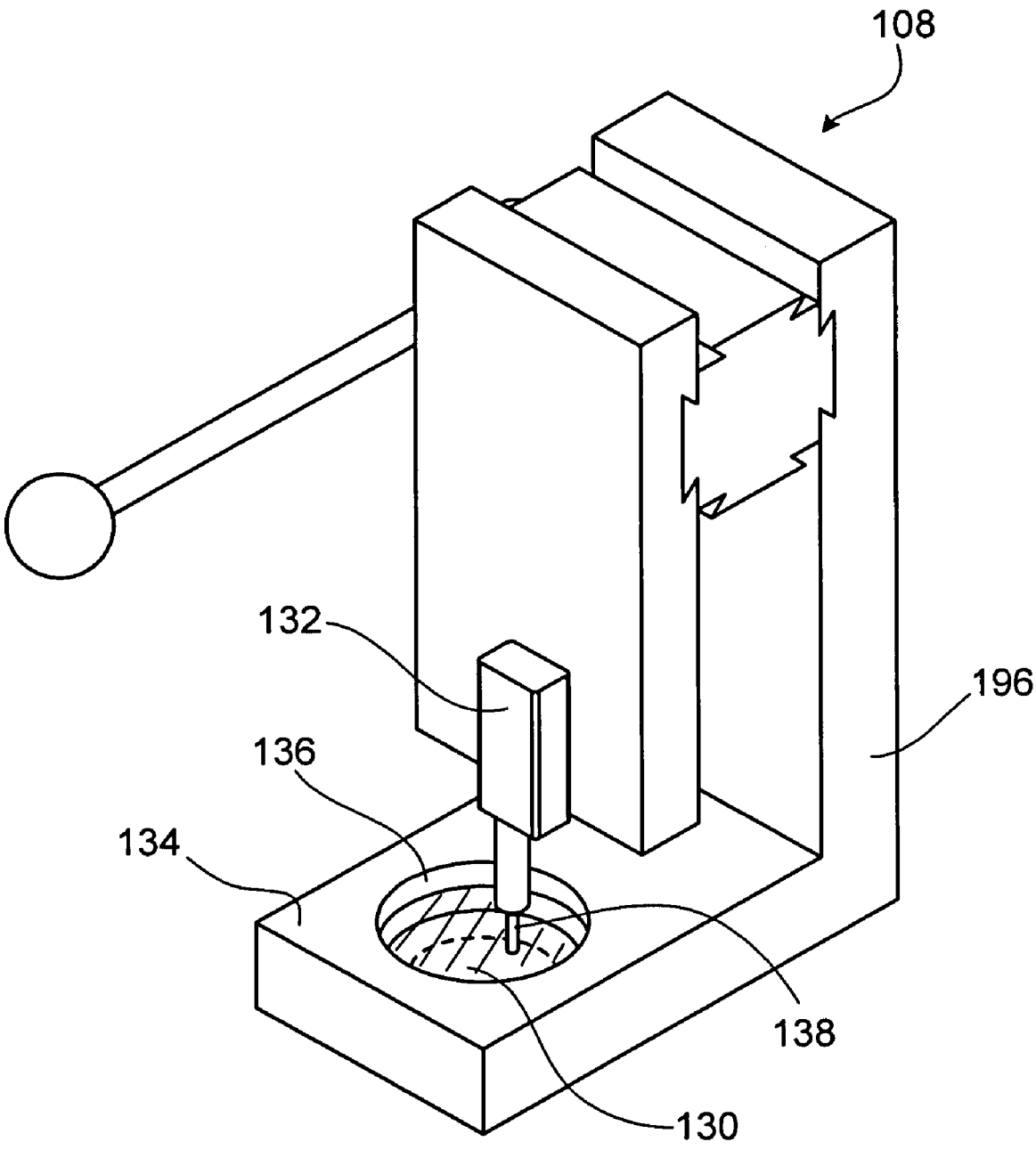
FIG. 3 is a perspective view of an example measuring stage.

Referring to FIG. 3, in some implementations, the measuring device 108 can include a metrology stage 196 having a puck 130 that rides on the surface of the lap as a means to bridge small discontinuities on the lap surface 102 and to provide physical averaging of the lap surface 102. For example, the measuring device 108 can include an LVDT 132 that measures positions of the puck 130, or a DMI that measures positions of a mirror or a retro-reflector (not shown in the figure) attached to the puck 130.

On a pitch lap, for example, the surface can be skimmed and roughened with a cutting tool to incorporate a pattern of V-notches as a mechanism for slurry distribution under the work item 104 and as a mechanism for reducing the flow path for the pitch itself as it deforms under pressure from the conditioning tool 106. In the absence of the puck 130, the probe of the LVDT 132 may be forced to follow an irregular path and may be bent and damaged by the side loads encountered.

In some implementations, the puck 130 is a circular disk of sapphire polished smooth and parallel and sized appropriately for the geometry of the lap deformations and the metrology hardware. For example, the puck 130 has a smooth surface having a diameter that is larger than a maximum width of the grooves on the lap surface 102. In some examples, the smooth surface has a diameter that is at least three times the maximum width of the grooves so that at least two-thirds of the puck bottom surface is supported at all times. The maximum width of the grooves refers to the maximum width of the grooves in the portion of the lap that needs to be measured. The metrology stage 196 has a lower section 134 having a circular opening 136 to accommodate the puck 130. The puck 130 is constrained to move with the metrology stage 196, including maintenance of rotational alignment, but free to follow the vertical contour of the lap surface 102. In the case of an LVDT measurement, an LVDT probe 138 contacts the upper surface of the puck 130 and provides a constant offset to the lap below. In the case of a DMI measurement, the puck 130 supports a mirror or a retro-reflector and provides a constant offset to the lap.

The measurement of the lap surface 102 can be accomplished by moving the measurement point in a generally radial direction while the lap rotates. This can be achieved by using the precision slide mechanism 122 with motorized translation via a ball-screw. This generates a spiral path with an operator-defined pitch and provides an opportunity to efficiently and repeatably interrogate the entire lap surface 102. When the motions of the lap rotation and the radial motion of the metrology system are servo controlled or monitored using encoder feedback, the exact position on the lap surface for every measurement can be known with precision.

The metrology system frame of reference can be, e.g., the linear slide 110 of the precision slide mechanism 122. The linear slide 110 is positioned on the polishing machine 100 closely perpendicular to the lap rotary axis, but it need not be perfectly perpendicular. The operator can make incremental changes to the shape of the lap until an acceptable surface figure is obtained for finishing the work item 104. After operating the polishing machine 100 for a period of time, an operator may understand what apparent shape is required without concern for the absolute radius of curvature used to generate the mathematically defined lap surface shape.

In addition to slide alignment, the error motion of the metrology stage 196 as it translates across the lap surface 102 is taken into account because any errors in this motion are interpreted as figure error in the lap. To some degree, these errors can be mapped and compensated for in the final calculations since they are generally related to manufacturing tolerances or errors in the slide geometry and are therefore repeatable.

Random errors can be accounted for by, e.g., over-sampling and local averaging, or performing multiple scans and averaging the measurements. In some examples where DMI measurements are made, an external optical mirror can be used as a reference frame to provide a high level of accuracy, precision and resolution. The mirror can be mounted above the mechanical slide 110, supported in a way to minimize gravity sag, and interrogated simultaneously with the lap measurements such that every measurement of the lap is combined with a measurement of the mirror so that error motions in the slide 110 are cancelled out.

A feature of the polishing machine 100 is the use of the small conditioning tool 106 to smooth lap anomalies generated by the work items 104 being polished and change the overall degree of curvature of the finishing lap surface 102 to help generate the conditions necessary to achieve the required surface figure on the work item 104 being finished. The operator can use, e.g., radial positioning, pressure, and/or rotation rate of the conditioning tool 106 to manage the correction processes.

In some examples, especially using traditional large conditioning tools, the operator may detect excessive edge roll or a $3^{rd}$ order spherical term (hole-and-roll). Some designs, especially traditional designs for the conditioning tool support mechanism, may result in unwanted moments about the support point and cause the leading or trailing edge (relative to the circular motion of the lap) of the conditioning tool 106 to dig into the lap causing an overall toroidal surface figure on the lap. In the case of this small computer controlled conditioning tool 106, the effect of this moment can be accounted for in the calculated work function that is developed for the conditioning tool 106 and the other machine operating parameters. This is a very significant benefit of the system described herein. Assuming the conditioning tool 106 is small enough (e.g., has a tool diameter that is nominally less than half the diameter of the work item 104), the residual ripple left by the work function as it is convolved over the lap surface 102, is of a sufficiently short spatial period that the normal averaging mechanisms of the work item being processed on the lap of the polishing machine 100 smooth out the ripple effect.

When using the small conditioning tool 106 there may also be edge roll on the polishing lap over a distance of approximately the conditioning tool diameter from any free edge on the polishing lap that cannot be bridged by the conditioning tool 106. The problem of edge roll can be managed by extending the annular boundaries of the lap inward or outward sufficient to insure that the edge roll occurs outside the normal work zone.

In some examples, if the work item 104 has a small size, the conditioning tool 106 can be selected to have a size that is larger than the work item 104 so that the spatial period of the ripple is greater than the work item size and goes "unnoticed."

In some implementations, the polishing machine 100 is designed so that a variety of conditioning tools with varying sizes can be easily swapped into the machine as needed. In some examples, the conditioning tool size is about half the size of the work item 104 being finished so the work items 104 can easily bridge the ripples and offset their effects through normal surface averaging principles. In some examples, a conditioning tool is chosen such that the tool is much larger than the work item 104 being finished so the ripple goes "unnoticed."

When using the small conditioning tool 106, moments about the support point may cause either the leading or trailing edge (relative to the circular motion of the lap) of the tool 106 to "dig into" the lap causing an overall toroidal surface figure on the lap. This effect can be accounted for in the use of a work function that incorporates this effect.

Figure 4:
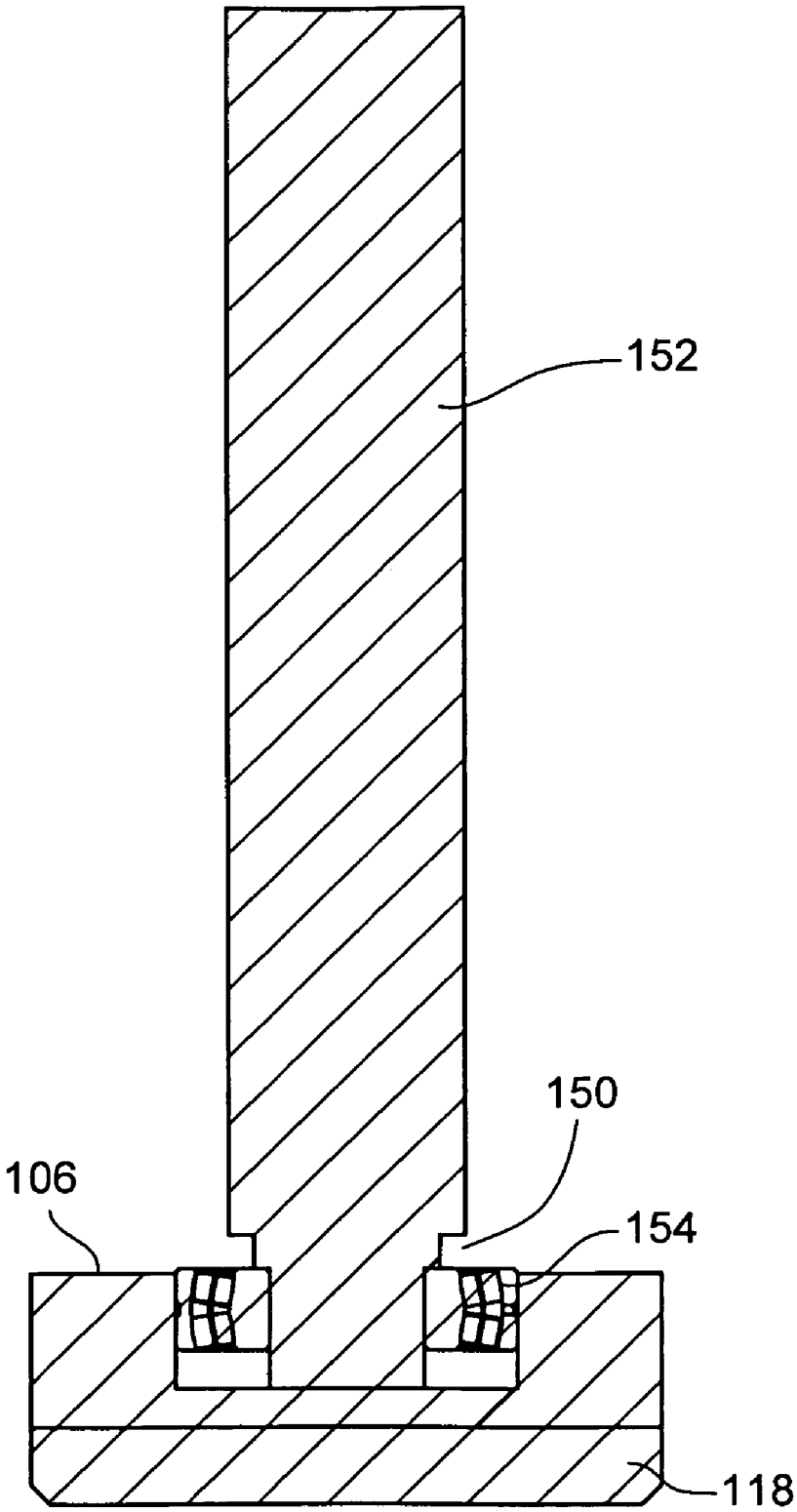
FIG. 4 is a cross-sectional diagram of an example conditioning tool.

FIG. 4 shows an example interface 150 between the conditioning tool 106 and a hydraulic cylinder 152. Here, the conditioning tool 106 is not actively driven, and relies on the rotary motion of the lap to slowly revolve the conditioning tool 106. The interface 150 includes spherical roller bearings 154 that allow free rotation while also allowing the conditioning tool 106 to easily conform to the lap surface 102. This is useful when a non-plano lap shape is desired. In some examples, the interface 150 can include a pair of plain radial bearings that allow rotation but not allow other degrees of freedom. Such interface can be used for a plano lap. In some examples, the interface 150 can include an active rotary drive that drives the conditioning tool 106.

The following describes the motion and pressure control for the conditioning tool 106. Computer numerical controlled (CNC) programs can be used, with proper feedback from linear and rotary encoders, to allow accurate positioning and speed control for the lap, the conditioning tool, and the metrology instrument stage translation. The conditioning tool pressure is determined by a hydraulic system and can be controlled through use of a digitally controlled pressure regulator that can increase or decrease pressure through a programmable ramp with good accuracy. For an actively driven conditioning tool 106, the conditioning tool rotary speed can be controlled using CNC programming.

Figure 5:
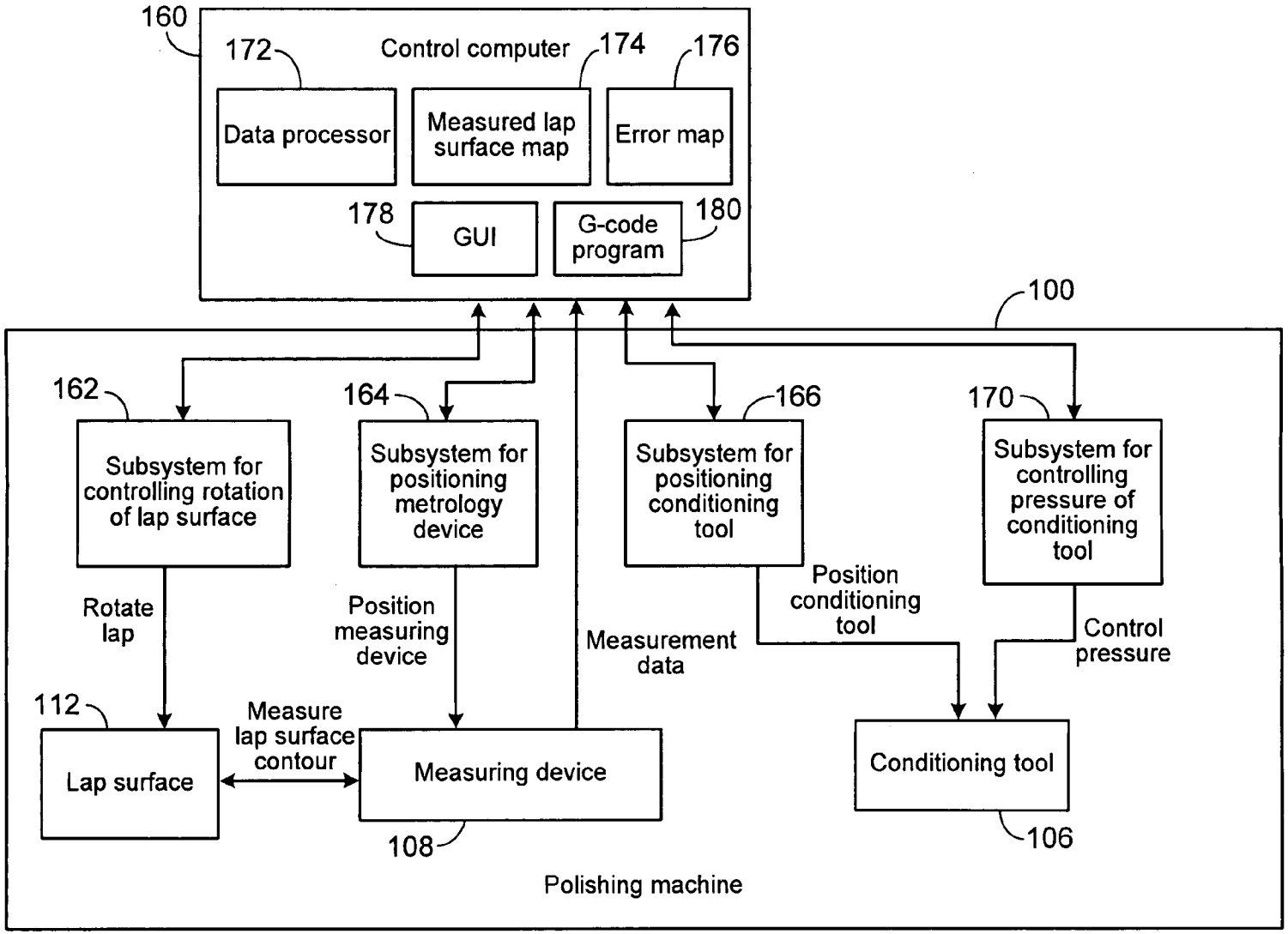
FIG. 5 is a block diagram of an example control computer and the polishing machine.

Referring to FIG. 5, the control computer 160 can control various subsystems of the polishing machine 100. For example, the polishing machine 100 may include a subsystem 162 for controlling rotation of the lap surface 102, a subsystem 164 for positioning the measuring device 108, a subsystem 166 for positioning the conditioning tool 106, and a subsystem 170 for controlling the rotation speed and/or pressure of the conditioning tool 106. For example, the subsystem 162 can include the belt drive mechanism 192, the subsystem 164 can include the precision slide mechanism 122, the subsystem 166 can include the precision slide mechanism 116, and the subsystem 170 can include the hydraulic device 114.

The control computer 160 includes a data processor 172 and a storage (e.g., memory or hard drive) to store a measured lap surface map 174 and an error map 176. A GUI 178 is provided to enable the operator to easily control various parameters of the polishing machine 100. The computer 160 executes a G-code program 180 to control various components of the polishing machine 100.

In some examples, the computer 160 controls the subsystem 162 to rotate the lap surface 102 at a steady rate. The computer 160 controls the subsystem 164 to position the measuring device 108, which measures the contour of the lap surface 102 and sends the measurement data back to the computer 160. The computer 160 generates the measured lap surface map 174 based on the data provided by the measuring device 108. The computer 160 compares the measured lap surface map 174 with a desired surface contour, and generates an error map 176. Based on the error map 176, the computer calculates the motion and pressure profiles of the conditioning tool 106 in order to reduce the error. The computer 160 converts the motion and pressure profiles into a G-code program 180, then executes the G-code program 180 to control various components of the polishing machine 100 to cause the conditioning tool 106 to have the calculated motion and pressure to reduce the error specified in the error map. The control computer 160 repeats the steps above, including controlling subsystem 164 to position the measuring device 108, using the measuring device 108 to measures the lap surface 102, using the measurement data to update the measured lap surface map 174 and error map 176, generating the G-code program 180, using the G-code program to control the movement and pressure of the conditioning tool 106 to polish the lap surface 102, and so forth. At the same time, the work items 104 are placed on the lap surface 102 and processed by the lap surface 102.

Figure 6:
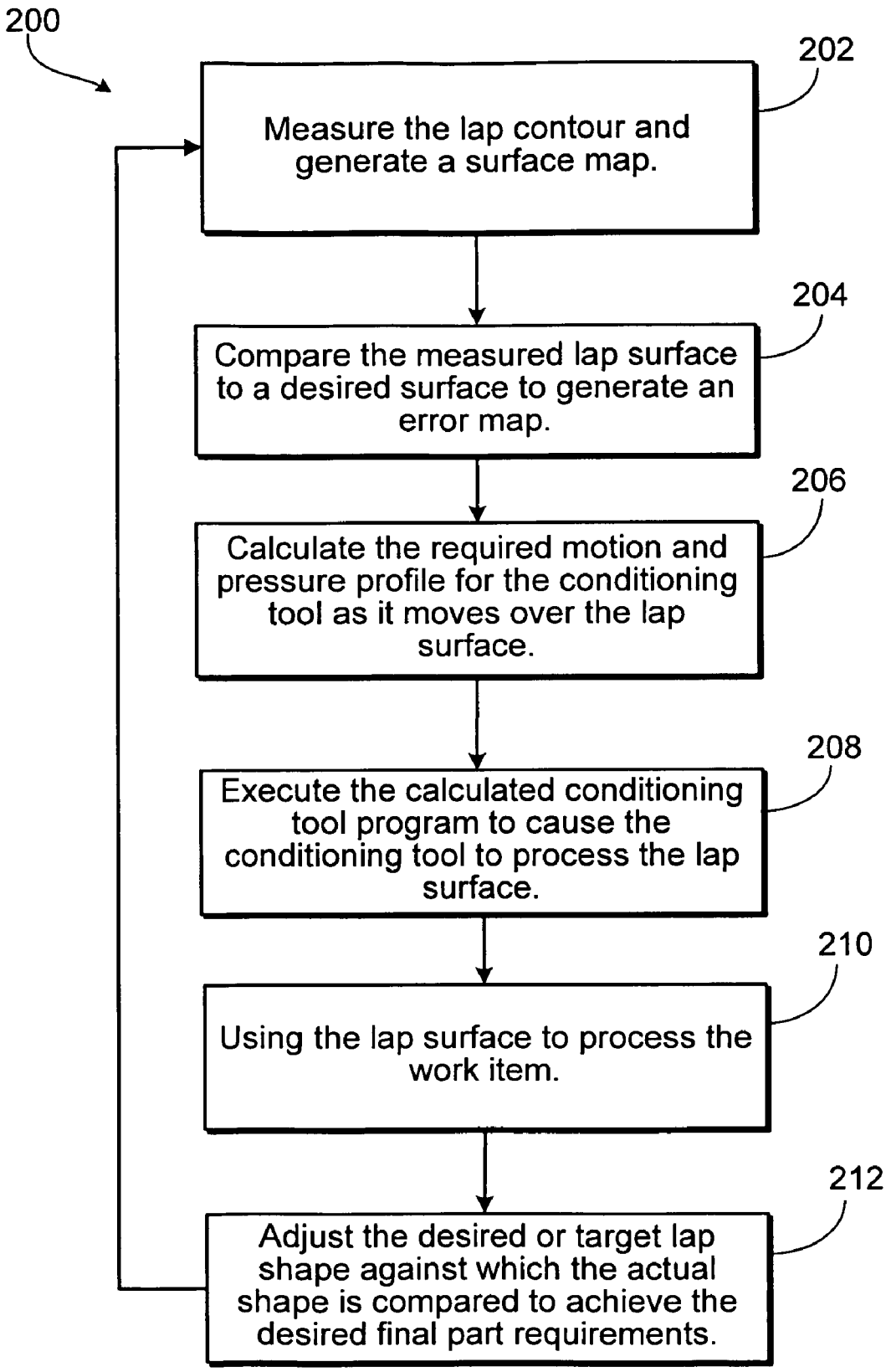
FIG. 6 is a flow diagram of an example process.

FIG. 6 is a flow diagram of an example process 200 for operating a lapping machine or a polishing machine. For example, the polishing machine can be the polishing machine 100 of FIG. 1. In the process 200, the lap contour is measured and a surface map is generated (202). For example, the measuring device 108 can be used to measure the lap contour, and the control computer 160 can generate the surface map 174.

The measured lap surface is compared to a desired surface to generate an error map (204). For example, the computer 160 can compare the surface map 174 to a desired surface to generate the error map 176.

The required motion and pressure profile for the conditioning tool as it moves over the lap surface is calculated (206). For example, the control computer 160 can calculate the required motion and pressure profile for the conditioning tool 106 as it moves over the lap surface 102.

A calculated conditioning tool program is executed to cause the conditioning tool to process the lap surface (208). For example, the computer 160 can execute the G-code program 180 to cause the conditioning tool 106 to process the lap surface 102.

The lap surface is used to process the work item (210). For example, the lap surface 102 is used to polish the work item 104. Processing of the work item 104 can be performed continuously and in parallel to steps 202 to 208 and 212 of the process 200.

The desired or target lap shape against which the actual shape is compared to achieve the desired final part requirements is adjusted (212).

Steps 202 to 212 are repeated.

A number of implementations have been described. Nevertheless, it will be understood that various modifications may be made without departing from the spirit and scope of the invention. Any of the methods described above can be implemented, for example, in computer hardware, software, or a combination of both. The methods can be implemented in computer programs using standard programming techniques following the descriptions herein. Program code is applied to input data to perform the functions described herein and generate output information. The output information is applied to one or more output devices such as a display monitor. Each program may be implemented in a high level procedural or object oriented programming language to communicate with a computer system. However, the programs can be implemented in assembly or machine language, if desired. In any case, the language can be a compiled or interpreted language. Moreover, the program can run on dedicated integrated circuits preprogrammed for that purpose.

Each such computer program is preferably stored on a storage medium or device (e.g., RAM, ROM, Flash memory, optical disc, or magnetic disk) readable by a general or special purpose programmable computer, for configuring and operating the computer when the storage media or device is read by the computer to perform the procedures described herein. The computer program can also reside in cache or main memory during program execution. The method can also be implemented as a computer-readable storage medium, configured with a computer program, where the storage medium so configured causes a computer to operate in a specific and predefined manner to perform the functions described herein.

Other aspects, features, and advantages are within the scope of the invention. For example, the polishing machine 100 can be replaced by a lapping machine that uses the finishing surface of a hard substrate to process the work item without using a polishing pitch. In this case, the small conditioning tool 106 can be motor driven and achieve variation in local lap surface change through changes in tool rotary speed. For example, the rotating tool surface can wear out parts of the hard substrate, and rotary speed variation can be used to correct lap surfaces. The work function can be generated by measuring the "before" and "after" of the surface of the lap material that is modified using a known rotational speed profile of the conditioning tool 106. In some examples, the small conditioning tool 106 may process the finishing surface using a combination of rotation and pressure, and the work function can be generated by measuring the "before" and "after" of the surface of the lap material that is modified using a known rotational speed and pressure profile of the conditioning tool 106.

The puck 130 can have any of a variety of shapes, such as an oval shape, and can be made from any of a variety of materials, as long as it has a smooth bottom that can glide over the pitch material and follow the vertical contour of the lap surface 102. The work item 104 can be of any shape, such as round or rectangular. In the description above, the diameter of the small conditioning tool 106 is smaller than the diameter of the work item 104. When the work item 104 is not round, the term "diameter" refers to the longest dimension (e.g., diagonal dimension of a square or rectangle) of the surface of the work piece that is in contact with the polishing lap.

Various techniques can be used to measure the positions of the puck 130, such as a proximity gauge that rides along a datum plane developed by a precision slide and measures the gap between the gauge and the puck 130. For example, the proximity gauge can be a short range position sensor that uses a laser to make a precision distance measurement over a small distance.

What is claimed is:

1. A method of processing a work item, the method comprising:

configuring a first finishing surface of a processing machine using a conditioning tool having a second finishing surface;

measuring a contour of the first finishing surface by measuring a movement of a measurement object in an opening of a section of a measurement stage, the measurement object comprising a puck that follows the contour of the first finishing surface;

using the second finishing surface to process the first finishing surface to reduce a difference between the measured contour and a desired contour for the first finishing surface; and using the first finishing surface to process a work item to cause the work item to have a surface contour that is equal to or approximates a specified surface contour.

2. The method of claim 1 in which configuring a first finishing surface of a processing machine comprises configuring a first finishing surface of at least one of a lapping machine or a polishing machine.

3. The method of claim 1 in which using a conditioning tool having a second finishing surface comprises using a conditioning tool having a second finishing surface that has a diameter smaller than a diameter of a surface of the work item.

4. The method of claim 3, comprising generating ripples on the first finishing surface as the second finishing surface processes various portions of the first finishing surface, the ripples having a spatial period that is smaller than the diameter of the work item.

5. The method of claim 4, comprising canceling effects of the ripples on the first finishing surface when processing the work item using the first finishing surface.

6. The method of claim 1 in which measuring the contour of the first finishing surface comprises moving a measurement object across the first finishing surface and measuring positions of the measurement object while the measurement object follows the contour of the first finishing surface.

7. The method of claim 6 in which the first finishing surface comprises a surface of a material having grooves that cause discontinuities in the first finishing surface, and the measurement object has a diameter that is larger than a maximum width of the grooves.

8. The method of claim 6 in which measuring positions of the measurement object comprises at least one of (a) using a linear variable displacement transducer to measure the positions of the measurement object, (b) using a capacitive gauge to measure the positions of the measurement object, (c) using an inductive gauge to measure the positions of the measurement object, or (d) using a displacement measuring interferometer to measure positions of a mirror or retro-reflector attached to the measurement object.

9. The method of claim 1, comprising using the first finishing surface to process the work item in parallel to measuring the contour of the first finishing surface and using the second finishing surface to process the first finishing surface.

10. The method of claim 1 in which using the first finishing surface to process a work item comprises using the first finishing surface to process a surface comprising at least one of glass, ceramic, plastic, or metal.

11. The method of claim 1 in which configuring a first finishing surface comprises configuring a first finishing surface of a solid substrate.

12. The method of claim 1 in which configuring a first finishing surface comprises configuring a first finishing surface of a polishing pitch.

13. A method comprising:

moving a measurement object across a finishing surface of a material of a processing machine for processing surface contours of work items, the material having grooves that cause discontinuities in the finishing surface, the measurement object having a dimension that is larger than a maximum width of the grooves, the measurement object moving in an opening of a section of a measurement stage and comprising a puck that follows the contour of the finishing surface;

measuring positions of the measurement object; and determining, using a computer, a contour of the finishing surface based on the measurements of the positions of the measurement object.

14. The method of claim 13, further comprising comparing the determined contour with a desired contour for the finishing surface, and using a conditioning tool to process the finishing surface to reduce a difference between the determined contour and the desired contour for the finishing surface.

15. The method of claim 14, further comprising using the finishing surface to process a work item to cause the work item to have a specified surface contour.

16. The method of claim 13 in which measuring positions of the measurement object comprises at least one of (a) using a linear variable displacement transducer to measure the positions of the measurement object, (b) using a capacitive gauge to measure the positions of the measurement object, (c) using an inductive gauge to measure the positions of the measurement object, or (d) using a displacement measuring interferometer to measure positions of a mirror or a retro-reflector attached to the measurement object.

17. The method of claim 13 in which the material comprises polishing pitch.

18. An apparatus comprising:

a material having a first finishing surface to process a surface of a work item;

a measuring tool to measure a contour of the first finishing surface, the measuring tool comprising a measurement stage having a section having an opening, and a measurement object disposed in the opening and comprising a puck that follows the contour of the first finishing surface; and a conditioning tool having a second finishing surface to process the first finishing surface to reduce a difference between the measured contour and a desired contour of the first finishing surface.

19. The apparatus of claim 18 in which the material comprises grooves that cause discontinuities in the first finishing surface.

20. The apparatus of claim 19 in which the material comprises polishing pitch.

21. The apparatus of claim 19 in which the measuring tool comprises a measurement object that moves across the first finishing surface, the measurement object having a size that is larger than a maximum width of the grooves.

22. The apparatus of claim 21 in which the measuring tool comprises a stage to support a sensor that senses positions of the measurement object, the stage constraining movements of the measurement object.

23. The apparatus of claim 22 in which the stage constrains the movements of the measurement object such that the measurement object has a single degree of freedom.

24. The apparatus of claim 21 in which the measurement object has a smooth surface that contacts the first finishing surface, the smooth surface having a dimension that is larger than the maximum width of the grooves.

25. The apparatus of claim 19 in which the measuring tool comprises at least one of a linear variable displacement transducer to measure positions of the measurement object, a capacitive gauge to measure positions of the measurement object, an inductive gauge to measure positions of the measurement object, or a displacement measuring interferometer to measure positions of a mirror or a retro-reflector attached to the measurement object.

26. The apparatus of claim 18 in which the second finishing surface has a size that is smaller than a size of a surface of the work item.

27. The apparatus of claim 18 in which the second finishing surface has a diameter that is less than one-half of a diameter of a surface of the work item.

28. The apparatus of claim 18 in which the first finishing surface comprises a finishing surface of at least one of cast iron or granite.

29. The apparatus of claim 18 in which the first finishing surface has a diameter of at least 3 feet, and the measuring tool has a resolution of 10 microns or smaller.

30. The apparatus of claim 18, further comprising a controller to control processing of the work item by the first polishing surface in parallel to using the measuring tool to measure the contour of the first finishing surface and using the conditioning tool to process the first finishing surface.

31. The apparatus of claim 18, further comprising a positioning device to position the measuring tool.

32. The apparatus of claim 31 in which the positioning device comprises a precision slide mechanism.

33. The apparatus of claim 18, further comprising a positioning device to position the conditioning tool.

34. The apparatus of claim 33 in which the positioning device comprises a precision slide mechanism.

35. The apparatus of claim 18, further comprising a pressure control device to control a pressure applied by the second finishing surface to the first finishing surface.

36. An apparatus comprising:

a material having a finishing surface to process a work item, the material comprising grooves that cause discontinuities in the finishing surface;

a measuring device to measure a contour of the finishing surface, the measuring device comprising a measurement stage having a section having an opening, and a measurement object disposed in the opening and comprising a puck that follows the contour of the finishing surface as the measurement stage and the measurement object move across the finishing surface, the puck having a dimension larger than a maximum width of the grooves; and a data processor to determine a contour of the finishing surface based on the measurements of positions of the measurement object.

37. The apparatus of claim 36 in which the material comprises polishing pitch.

38. The apparatus of claim 36 in which the material comprises a solid substrate.

39. The apparatus of claim 36 in which the measuring device comprises a measurement object that moves across the first finishing surface, the measurement object having a diameter that is larger than a maximum width of the grooves.

40. The apparatus of claim 39 in which the measuring device comprises a stage to support a sensor that senses positions of the measurement object, the stage constraining movements of the measurement object.

41. The apparatus of claim 40 in which the stage constrains the movements of the measurement object such that the measurement object has a single degree of freedom.

42. The apparatus of claim 36 in which the measuring device comprises at least one of a linear variable displacement transducer to measure the positions of the measurement object, a capacitive gauge to measure positions of the measurement object, an inductive gauge to measure positions of the measurement object, or a displacement measuring interferometer to measure positions of a mirror or retro-reflector attached to the measurement object.

43. The apparatus of claim 36 in which the second finishing surface has a diameter that is smaller than a diameter of a surface of the work item.

* * * * *